US011530539B2

(12) United States Patent
Roh et al.

(10) Patent No.: US 11,530,539 B2
(45) Date of Patent: Dec. 20, 2022

(54) MODULAR WALL ASSEMBLY USING SOLENOID

(71) Applicants: Won Hoon Roh, Osan-si (KR); Christopher William Tucker, Spanaway, WA (US)

(72) Inventors: Won Hoon Roh, Osan-si (KR); Christopher William Tucker, Spanaway, WA (US)

( * ) Notice: Subject to any disclaimer, the term of this patent is extended or adjusted under 35 U.S.C. 154(b) by 0 days.

(21) Appl. No.: 17/740,941

(22) Filed: May 10, 2022

(65) Prior Publication Data

US 2022/0364371 A1 Nov. 17, 2022

(30) Foreign Application Priority Data

May 13, 2021 (KR) ..... 10-2021-0061919

(51) Int. Cl.
*E04F 13/08* (2006.01)
*H01F 7/20* (2006.01)

(52) U.S. Cl.
CPC ..... *E04F 13/0862* (2013.01); *E04F 13/0869* (2013.01); *E04F 13/0883* (2013.01); *H01F 7/20* (2013.01); *E04F 2290/02* (2013.01)

(58) Field of Classification Search
CPC ..... E04F 13/07; E04F 13/074; E04F 13/08; E04F 13/0801; E04F 13/0803; E04F 13/0805; E04F 13/0832; E04F 13/0862; E04F 13/0869; E04F 13/088; E04F 13/0883; E04F 13/30; E04F 2201/06; E04F 21/1866; H01F 7/20; E04B 2002/7468; E04B 2/7407; E04B 2/7422; E04B 2/7425; E04B 2/7433; E04B 2/789
See application file for complete search history.

(56) References Cited

U.S. PATENT DOCUMENTS 1,966,041 A * 7/1934 Nelson ..... E04F 13/0842 52/762
2,543,626 A * 2/1951 Grothouse ..... E04F 13/0803 52/745.09

(Continued)

FOREIGN PATENT DOCUMENTS

JP 2005-517841 A 6/2005
JP 2017-105188 A 6/2007

(Continued)

*Primary Examiner* — Kyle J. Walraed-Sullivan
(74) *Attorney, Agent, or Firm* — Quantum Patent Law Firm; Seongyoune Kang

(57) ABSTRACT

A modular wall assembly using a solenoid is disclosed. The modular wall assembly includes a plurality of main frames fixed to an installation surface; a supply line mounted on an inside of each of the plurality of main frames; a withdrawal connector arranged exposed on an outside of each of the plurality of main frames; a plurality of installation frames arranged in two dimensions in the plurality of main frames; a detachable unit mounted on each of the plurality of installation frames; and a coupling connector mounted on each of the plurality of installation frames. According to the present invention, a panel is easily assembled and installed, a product requiring water, a signal, or electricity is easily installed, and various types of wall structures are provided.

5 Claims, 12 Drawing Sheets

(56) References Cited

U.S. PATENT DOCUMENTS 3,310,924 A * 3/1967 Boynton ..... E04B 2/58 52/479
3,982,370 A * 9/1976 Buffington ..... E04B 2/7457 52/511
3,986,312 A * 10/1976 Calhoun ..... E04B 2/7457 52/DIG. 4
4,905,428 A * 3/1990 Sykes ..... E04B 2/745 52/270
4,958,671 A * 9/1990 Bove ..... E04B 2/7429 160/351
5,067,543 A * 11/1991 Bove ..... E04B 2/7429 160/369
6,125,600 A * 10/2000 Bastian ..... E04B 2/7422 52/287.1
7,373,747 B1 * 5/2008 Wiemer ..... G09F 7/00 40/605
8,042,308 B2 * 10/2011 Sullivan ..... G09F 7/18 434/408
8,511,023 B1 * 8/2013 Gulbrandsen ..... E04F 19/061 52/506.06
9,697,755 B1 * 7/2017 Zhang ..... G09F 15/0025
10,329,773 B1 * 6/2019 Ferguson ..... E04F 13/083
10,526,790 B1 * 1/2020 Ferguson ..... E04F 13/0814
10,672,306 B1 * 6/2020 Whidden ..... G09F 15/0068
10,697,183 B1 * 6/2020 Ferguson ..... E04F 13/083
2002/0129574 A1 * 9/2002 Newhouse ..... B25B 5/003 52/239
2003/0112591 A1 * 6/2003 Zodnik ..... G06F 1/16 361/679.02
2004/0093805 A1 * 5/2004 Underwood ..... E04B 2/82 52/239
2008/0302054 A1 * 12/2008 Gosling ..... E04B 2/7425 52/745.05
2010/0186326 A1 * 7/2010 Cummings ..... E04B 2/7422 52/745.1
2013/0205698 A1 * 8/2013 Todd ..... E04F 13/072 52/302.1
2013/0269273 A1 * 10/2013 Mayo ..... E04F 13/0862 52/391
2014/0096467 A1 * 4/2014 Norton ..... E04F 13/0883 52/582.2
2014/0197123 A1 * 7/2014 McPhillips ..... A63F 1/02 211/195
2014/0197124 A1 * 7/2014 McPhillips ..... G09F 19/228 211/195
2015/0143763 A1 * 5/2015 Gosling ..... E04B 2/7448 52/745.1
2016/0102462 A1 * 4/2016 Griffiths ..... E04F 13/0862 52/550
2016/0273214 A1 * 9/2016 Kopish ..... E04B 2/827
2016/0348359 A1 * 12/2016 Behrens ..... E04B 2/824
2016/0348361 A1 * 12/2016 Gosling ..... E04B 2/7425
2017/0258249 A1 * 9/2017 Kim ..... A47F 5/08
2017/0350147 A1 * 12/2017 Janko ..... E04F 13/0866
2018/0216343 A1 * 8/2018 Ollila ..... B65G 65/42
2018/0350277 A1 * 12/2018 Entwistle ..... F16M 13/022
2019/0040630 A1 * 2/2019 Piethman ..... E04B 2/7425
2019/0055737 A1 * 2/2019 Aboukhalil ..... E04F 13/0803
2019/0112819 A1 * 4/2019 Gebhardt ..... E04F 13/0882
2019/0136522 A1 * 5/2019 Stramandinoli ..... E04B 1/40
2019/0309512 A1 * 10/2019 Gosling ..... E05D 7/009
2021/0054991 A1 * 2/2021 Stary ..... E04C 2/38
2021/0087811 A1 * 3/2021 Lai ..... E04B 2/7425
2022/0013267 A1 * 1/2022 Kuo ..... H01F 7/02
2022/0034087 A1 * 2/2022 Himmler, Sr. ..... B43L 1/00
2022/0127846 A1 * 4/2022 Colin ..... E04B 2/7422

FOREIGN PATENT DOCUMENTS

JP 2010-150772 A 7/2010
KR 10-2014-0012370 A 2/2014
KR 10-1719297 B1 3/2017

* cited by examiner

MODULAR WALL ASSEMBLY USING SOLENOID

CROSS REFERENCE TO RELATED APPLICATION OF THE INVENTION

The present application claims priority to Korean Patent Application No. 10-2021-0061919 filed in the Korean Intellectual Property Office on May 13, 2021, the entire contents of which are incorporated herein by reference.

BACKGROUND OF THE INVENTION

Field of the Invention

The present invention relates to a modular wall assembly, and more particularly, to a modular wall assembly facilitating assembly and installation by using a solenoid and allowing a product requiring water, signals, or electricity to be easily installed.

Background of the Related Art

In general, wall assemblies form walls of various structures, such as houses, offices, and factories, by assembling a plurality of panels in a frame. Wall assemblies use various types of assembly structures for easy construction.

Such wall assemblies may form not only vertical walls but also various structures including ceilings.

As the prior art related to a wall assembly, there is Korea Patent No. 10-1719297, entitled "Wall Insulation System Assembly Having Seismic Vibration-Absorbing Panels".

However, wall assemblies according to the prior art are inconvenient to install and have the lack of expandability by not considering installation of other various devices than panels.

SUMMARY OF THE INVENTION

Accordingly, the present invention has been made in view of the above-mentioned problems occurring in the related art, and it is an object of the present invention to provide a modular wall assembly facilitating assembly and installation by using a solenoid, facilitating installation of not only a panel but also a product, e.g., a sprinkler, a humidifier, a frame aquarium, a speaker, or a television (TV), which requires water, signals, or electricity, facilitating supply of water, signals, or electricity required for the operation of the product, and providing various types of wall structures including shelves, cabinets, or furniture.

Other objects of the present invention will be easily understood from the embodiments described below.

To accomplish the above-mentioned objects, according to one aspect of the present invention, there is provided a modular wall assembly using a solenoid. The modular wall assembly includes a plurality of main frames fixed to an installation surface, the main frames being parallel with and separated from each other; a supply line mounted on an inside of each of the main frames, the supply line configured to supply water, a signal, or electricity; a withdrawal connector arranged exposed on an outside of each main frame, the withdrawal connector being connected to the supply line; a plurality of installation frames arranged in two dimensions in the main frames, each of the installation frames being installed in an edge of a panel or a product; a detachable unit mounted on each installation frame, the detachable unit being detachably coupled to each main frame and fixing each installation frame to each main frame; and a coupling connector mounted on each installation frame, the coupling connector being coupled to the withdrawal connector and thus connected to the supply line and being connected to a line for supplying, to the outside, the water, the signal, or the electricity supplied through the supply line.

Each main frame has a C-shaped cross-section such that an accommodating space is open in the length direction of the main frame, the accommodating space being provided for installation of the supply line, and each main frame has a plurality of detaching holes provided in end portions thereof to be separated from each other in a length direction of each main frame, the end portions being respectively at both sides of the opening of each main frame, wherein the detachable unit is coupled to each of the detaching holes such that a pair of adjacent installation frames are fixed to each main frame.

Each installation frame includes a mounting frame having a U-shape such that the panel or the product is slidably coupled to an inside of the mounting frame, the mounting frame including a slide coupling portion in the inside thereof to be sliding-coupled to a sliding groove of the panel or the product and having mounted thereon the detachable unit and the coupling connector; and a closing frame coupled to a side of the panel or the product to surround the edge of the panel or the product together with the mounting frame, the side of the panel or the product being exposed by an open side of the mounting frame.

The detachable unit includes a body mounted on each installation frame, the body being inserted into a detaching hole formed in each main frame; a solenoid fixed to an inside of the body, the solenoid being operated by a control signal of an operator mounted on each installation frame; a slider slidably mounted on the inside of the body, the slider having an attractive force to the solenoid according to an operation of the solenoid; a coupling member extending outwards from the slider; a plurality of link members hinged to the coupling member and arranged in a radial pattern from a center of the coupling member; a plurality of trapping members each having a first side, a second side, and a trap portion, the first side being hinged to an end of each of the link members, the second side being hinged to the body, the trap portion being trapped in the detaching hole, and the trapping members being configured to allow the trap portion of each of the trapping members to be released from the detaching hole by gathering toward the center of the coupling member when the coupling member pulls the link members according to the operation of the solenoid; and a spring mounted on the body and configured to produce an elastic force to allow each trapping member to return to an original position, at which the trap portion of each trapping member protrudes outwards and is trapped in the detaching hole.

The modular wall assembly may further include a mold mounted on each installation frame and thus mounted on each main frame via each installation frame, the mold allowing an artifact having a desired property and shape to be formed and fixed therein through molding and hardening of a composite.

The modular wall assembly may further include a transverse frame arranged in a transverse direction for installation of the installation frames, wherein a level is mounted on the transverse frame to check levelness.

BRIEF DESCRIPTION OF THE DRAWINGS

The above and other objects, features and advantages of the present invention will be apparent from the following detailed description of the embodiments of the invention in conjunction with the accompanying drawings, in which.

DETAILED DESCRIPTION OF THE EMBODIMENTS

Figure 1:
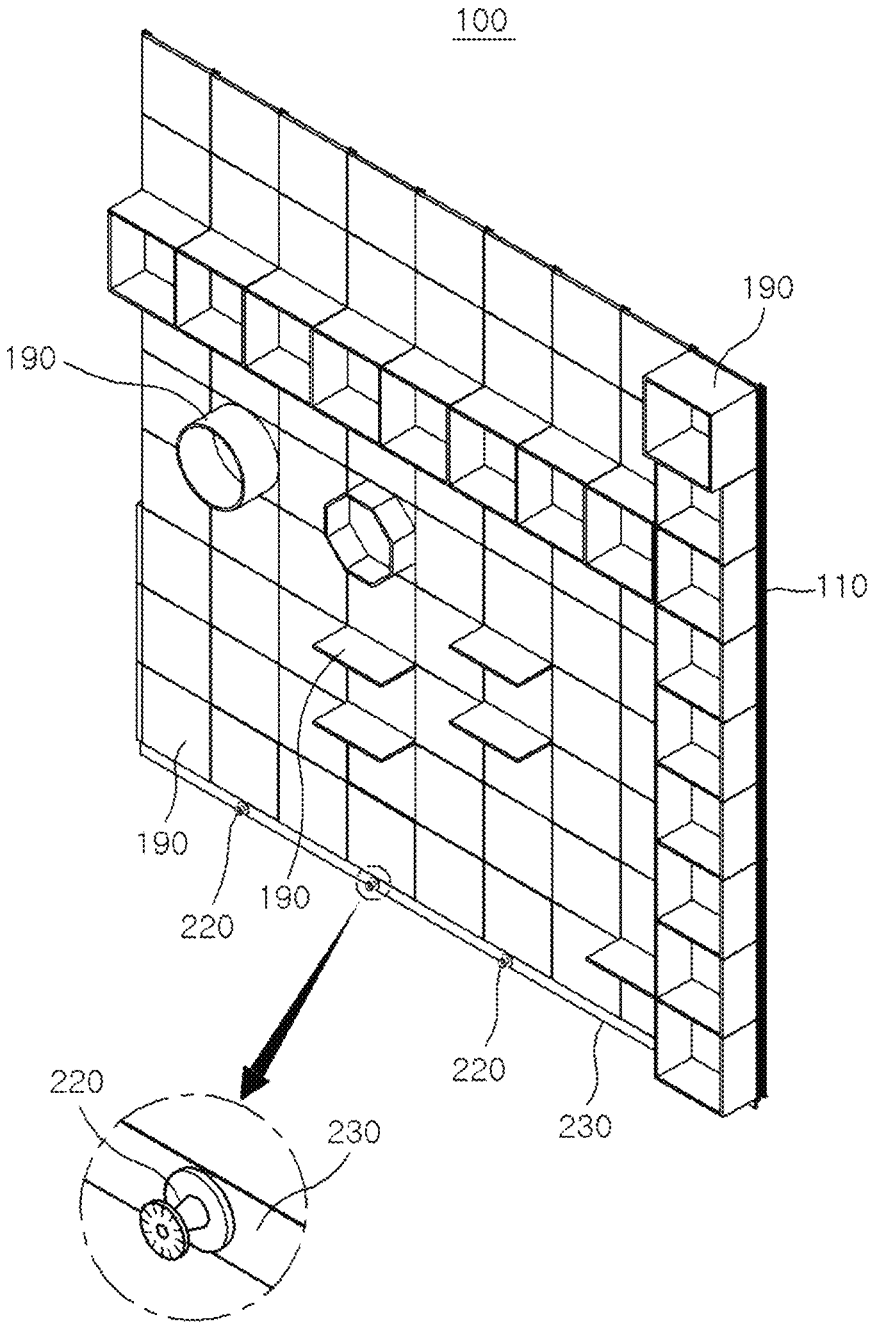
FIG. 1 is a perspective view illustrating a modular wall assembly using a solenoid, according to an embodiment of the present invention.

Hereinafter, embodiments of the present invention are described in detail with reference to the accompanying drawings. In the drawing, like reference numerals denote like elements, and redundant descriptions thereof are omitted.

Figure 2:
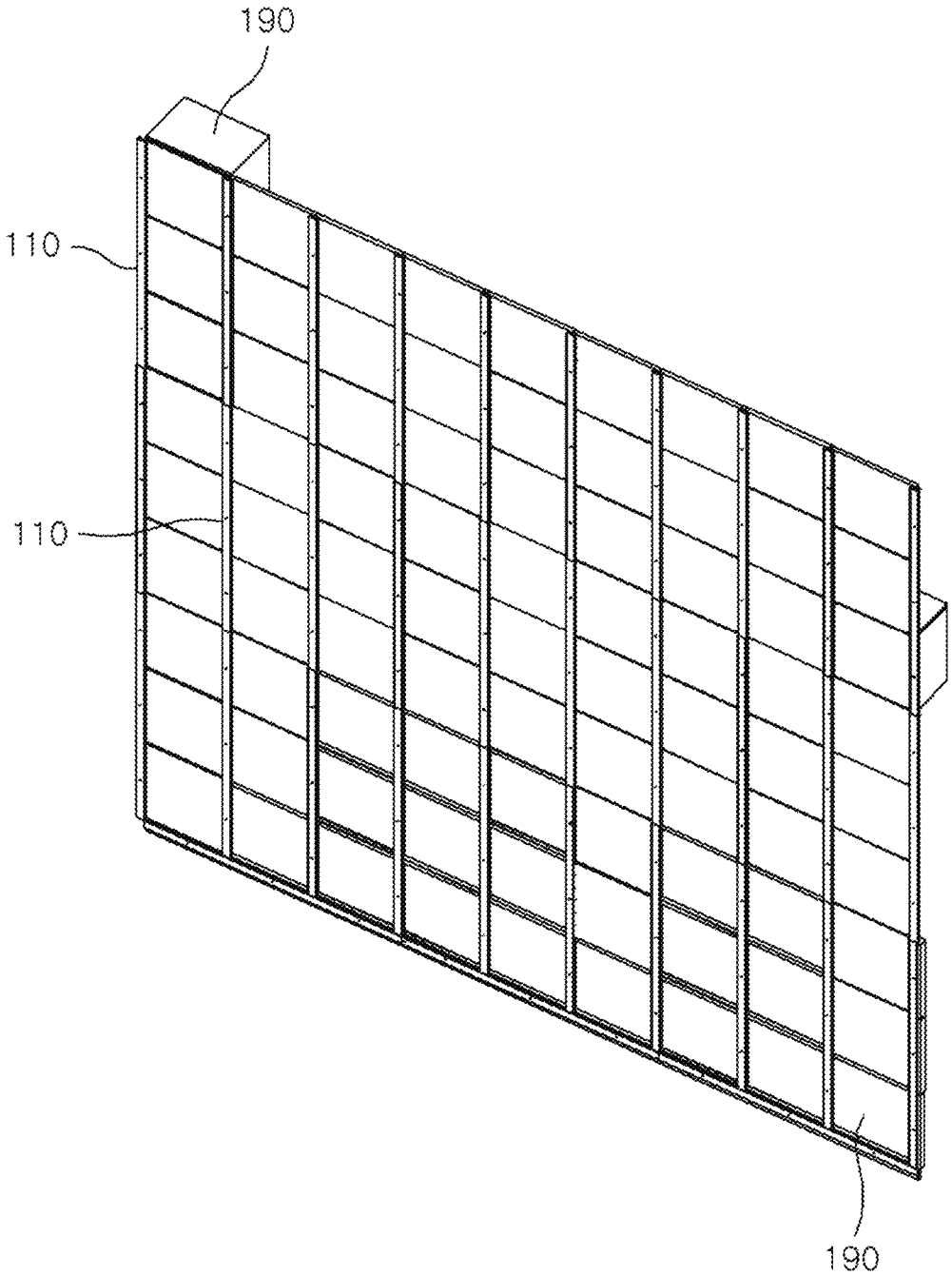
FIG. 2 is a rear perspective view illustrating a modular wall assembly using a solenoid, according to an embodiment of the present invention.
Figure 3:
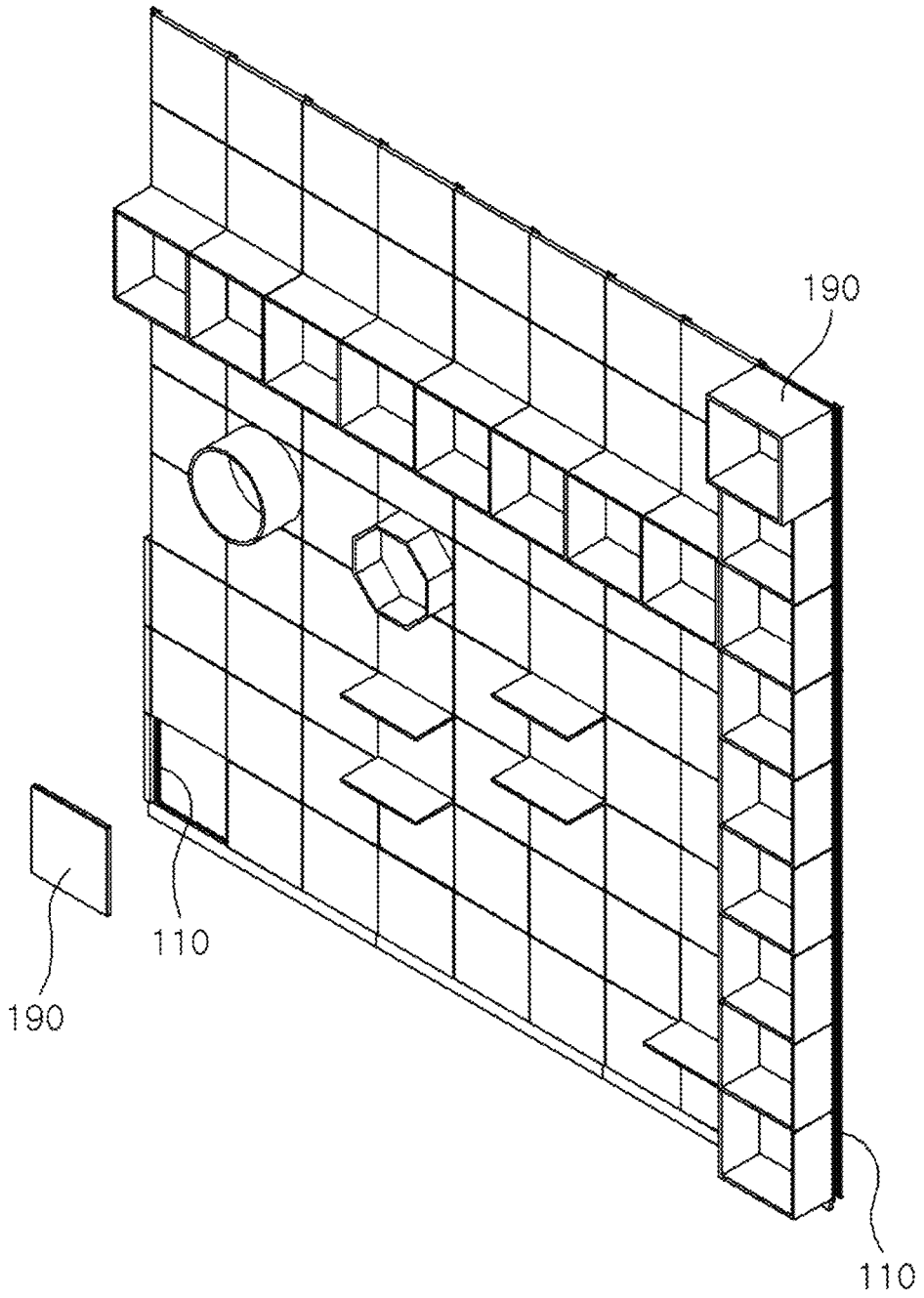
FIG. 3 is a partially exploded perspective view illustrating a modular wall assembly using a solenoid, according to an embodiment of the present invention.
Figure 4:
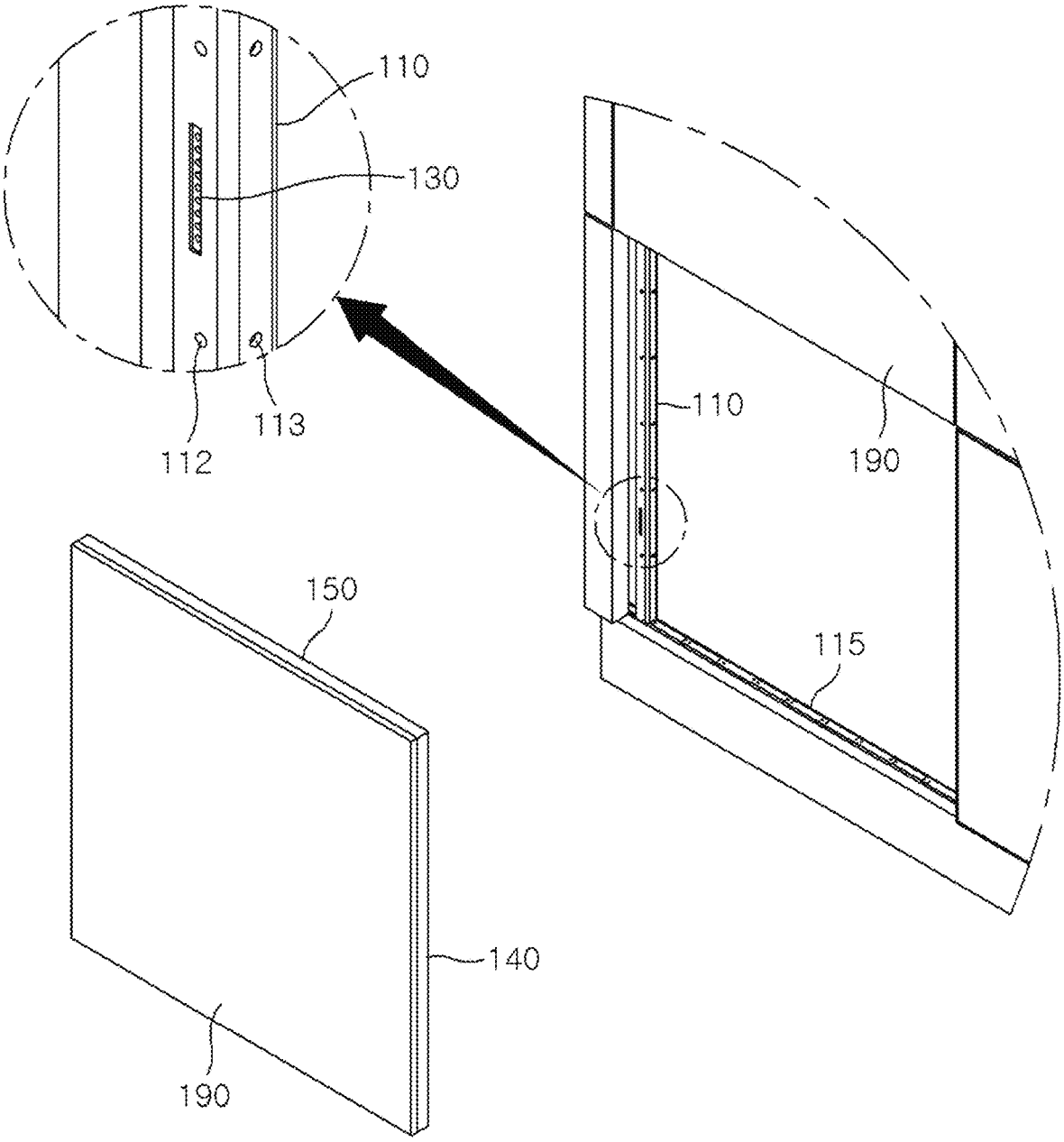
FIG. 4 is an exploded perspective view illustrating a portion of a modular wall assembly using a solenoid, according to an embodiment of the present invention.

FIG. 1 is a perspective view illustrating a modular wall assembly using a solenoid, according to an embodiment of the present invention. FIG. 2 is a rear perspective view illustrating a modular wall assembly using a solenoid, according to an embodiment of the present invention. FIG. 3 is a partially exploded perspective view illustrating a modular wall assembly using a solenoid, according to an embodiment of the present invention. FIG. 4 is an exploded perspective view illustrating a portion of a modular wall assembly using a solenoid, according to an embodiment of the present invention.

Figure 6:
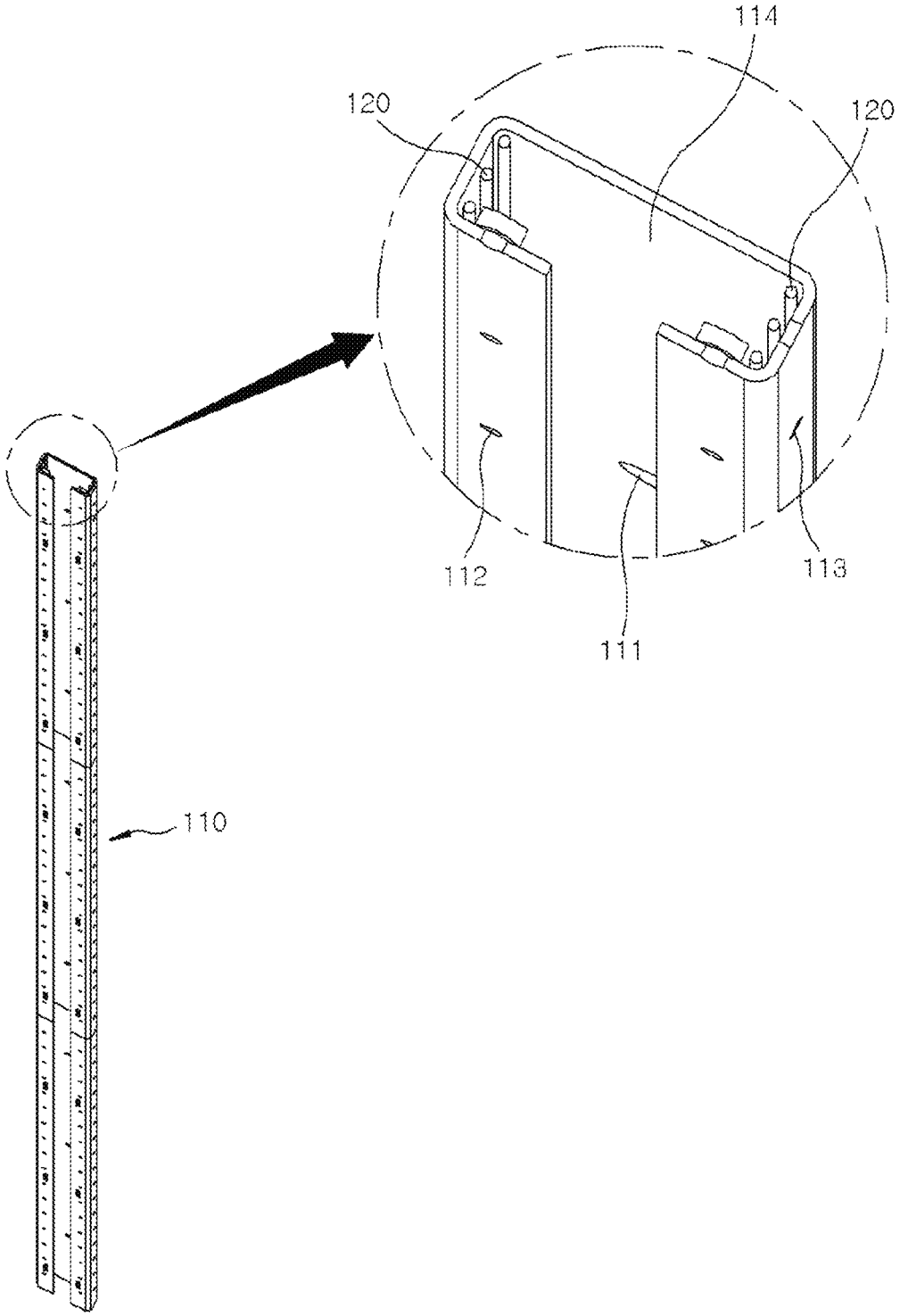
FIG. 6 is a perspective view illustrating a main frame of a modular wall assembly using a solenoid, according to an embodiment of the present invention.
Figure 7:
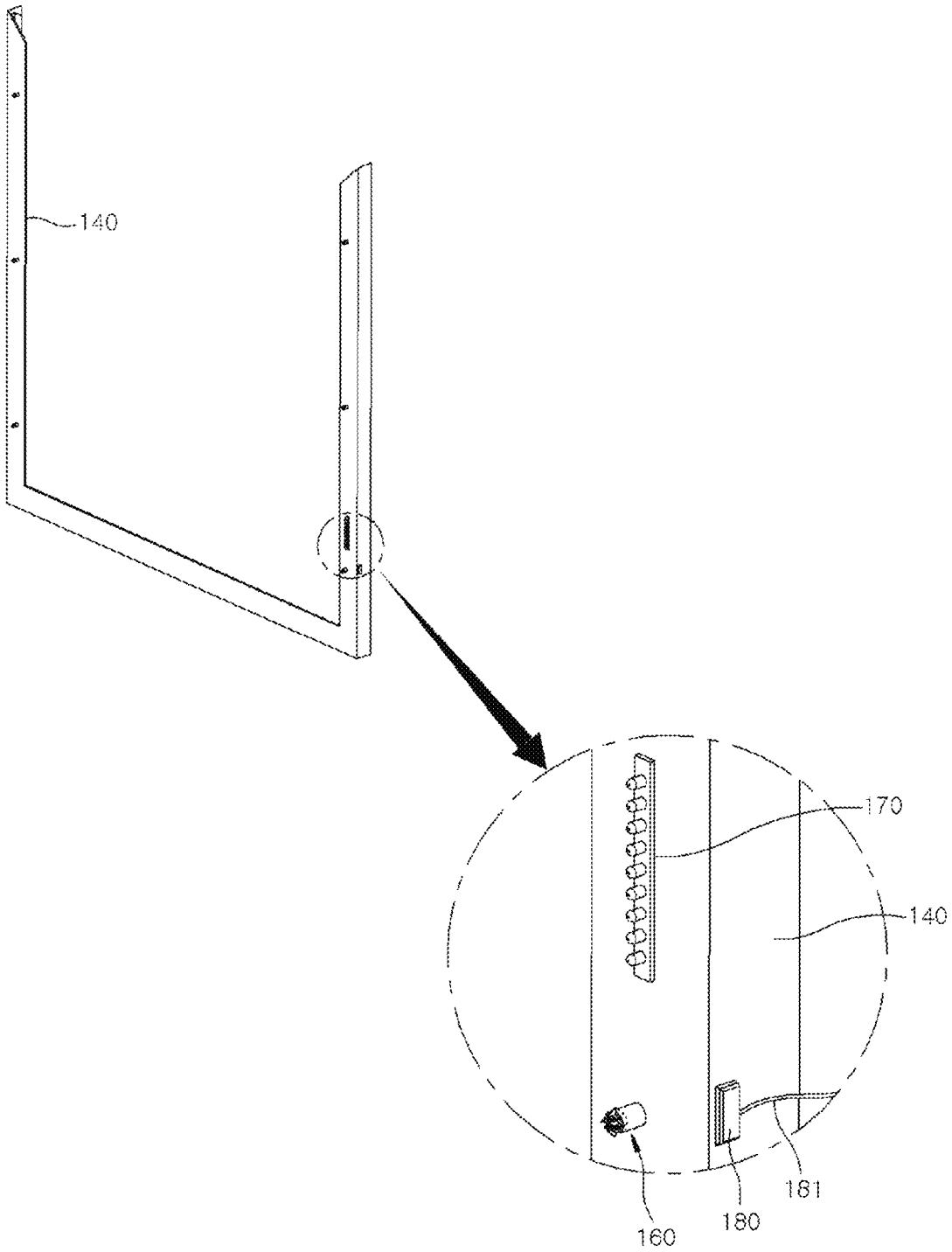
FIG. 7 is a rear perspective view illustrating an installation frame of a modular wall assembly using a solenoid, according to an embodiment of the present invention.
Figure 8:
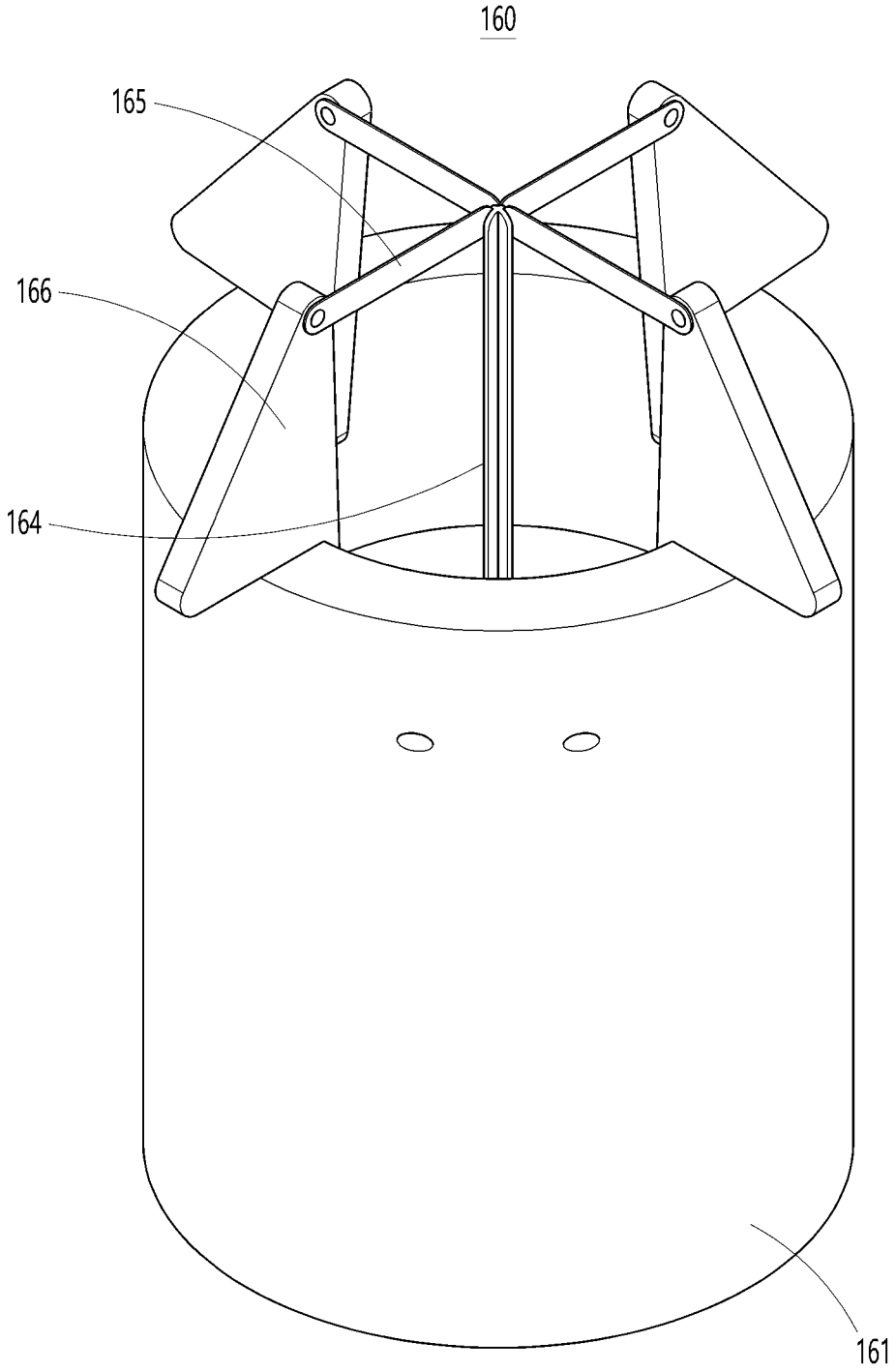
FIG. 8 is a perspective view illustrating a detachable unit of a modular wall assembly using a solenoid, according to an embodiment of the present invention, wherein the detachable unit is in a locked state.
Figure 9:
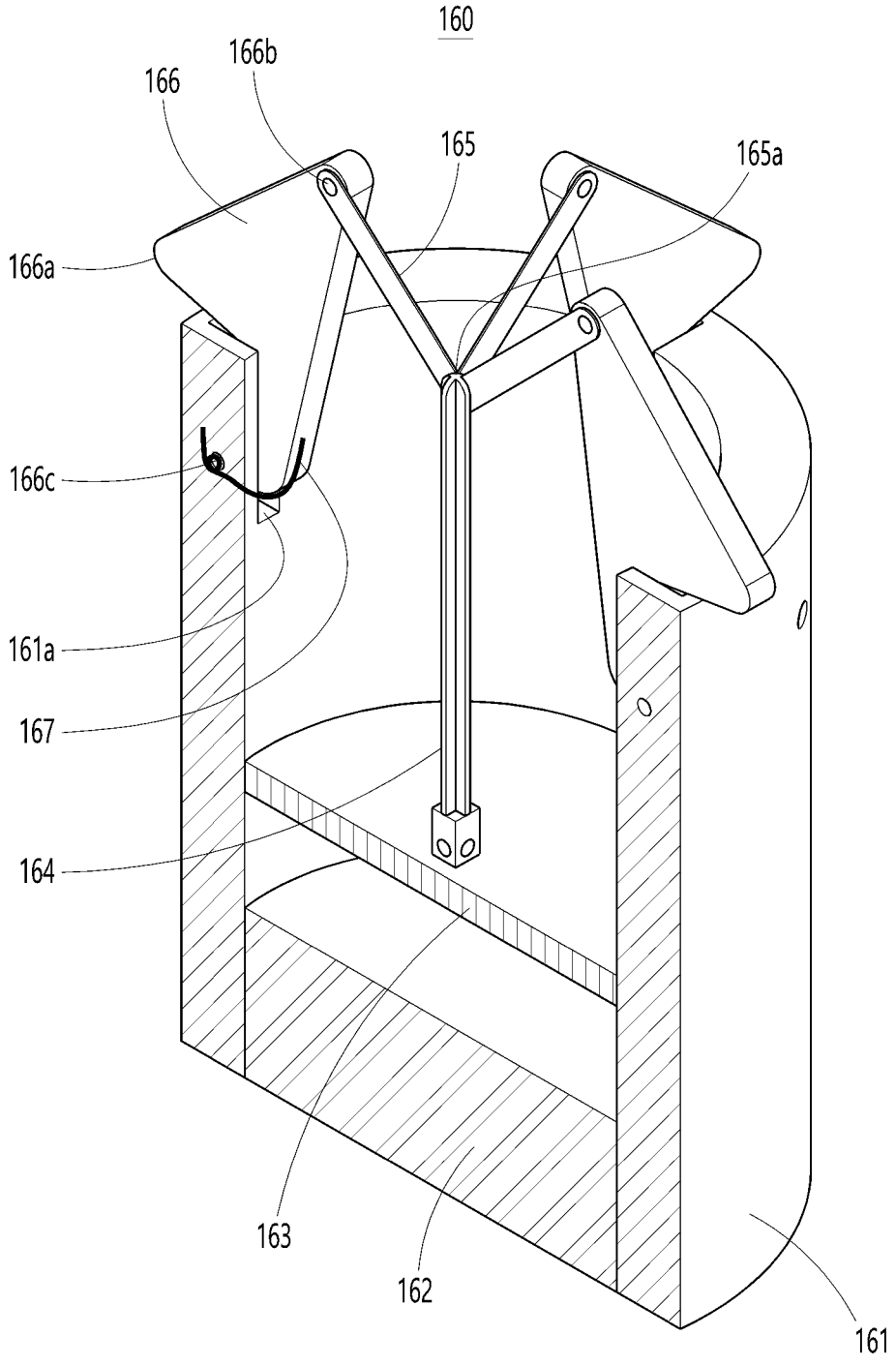
FIG. 9 is a cross-sectional perspective view illustrating a detachable unit of a modular wall assembly using a solenoid, according to an embodiment of the present invention, wherein the detachable unit is in a locked state.
Figure 10:
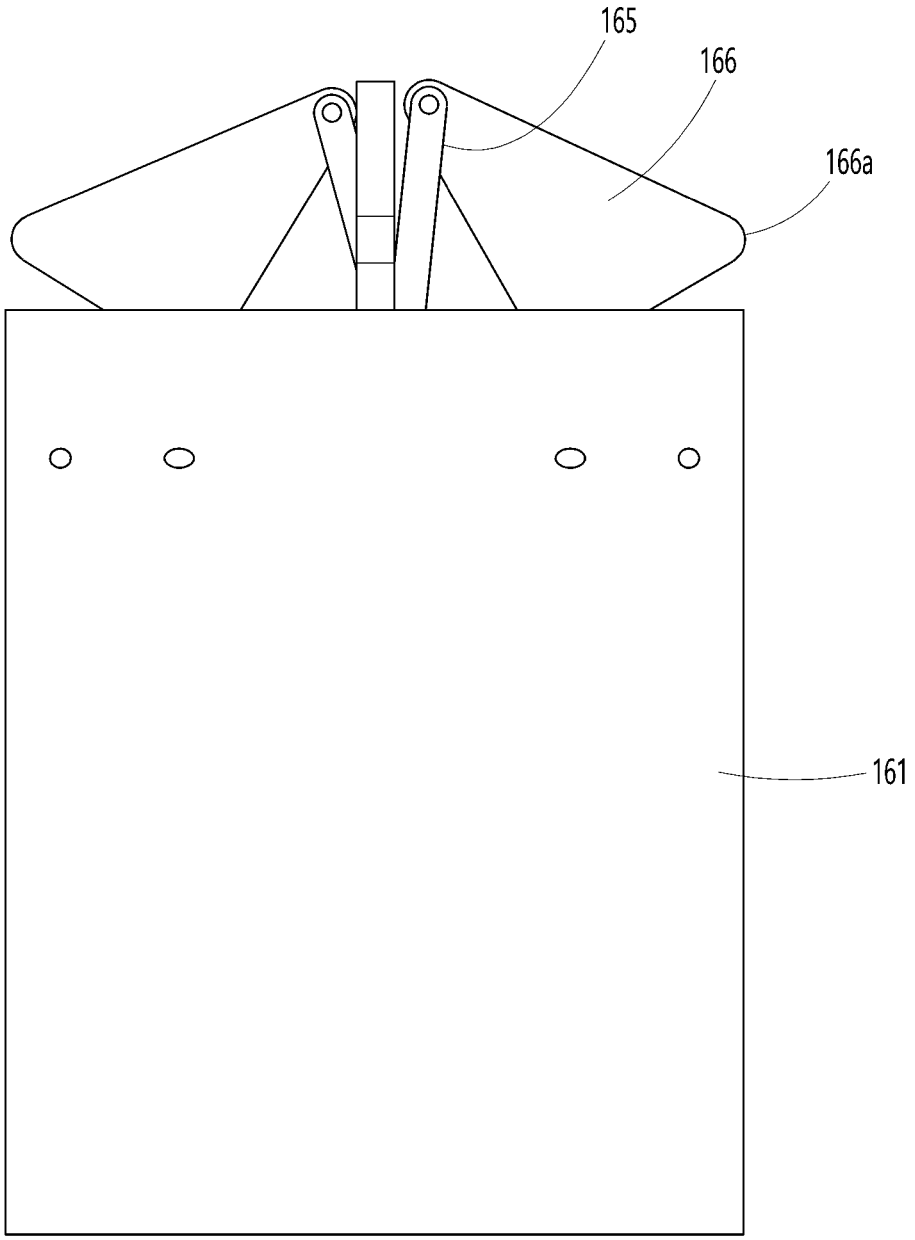
FIG. 10 is a cross-sectional view illustrating a detachable unit of a modular wall assembly using a solenoid, according to an embodiment of the present invention, wherein the detachable unit is in an unlocked state.

Referring to FIGS. 1 to 4, a modular wall assembly 100 using a solenoid may include a main frame 110, a supply line 120 (in FIG. 6), a withdrawal connector 130, an installation frame (including a mounting frame 140 and a closing frame 150), a detachable unit 160 (in FIGS. 7 to 10), and a coupling connector 170 (in FIG. 7).

Referring to FIGS. 1 to 4 and FIG. 6, a plurality of main frames 110 may be fixed to an installation surface to be separated from and parallel with each other. In the case of a vertical wall surface, a plurality of main frames 110 may be arranged to extend in a vertical direction and to be parallel with each other. However, embodiments are not limited thereto, and a plurality of main frames 110 may be arranged to extend in a horizontal direction and to be parallel with each other to form a ceiling or a floor. A plurality of fixing holes 111 may be provided in each main frame 110 such that the main frame 110 is fixed to an installation surface by using a bolt or the like. The fixing holes 111 may be apart from each other in a length direction of the main frame 110.

The main frame 110 may have a C-shaped cross-section such that an accommodating space 114, which is provided for the installation of the supply line 120, is open in the length direction of the main frame 110. A plurality of detaching holes 112 are provided in end portions, which are respectively at both sides of the opening of the main frame 110, to be separated from each other in the length direction of the main frame 110. The detachable unit 160 may be coupled to each of the detaching holes 112 such that an installation frame, and more particularly, the mounting frame 140 may be fixed to the main frame 110. When a plurality of main frames 110 are arranged in parallel with each other, the main frames 110 may be connected to each other by a transverse frame 115, which is cross-bolted or cross-coupled to the main frames 110.

Figure 12:
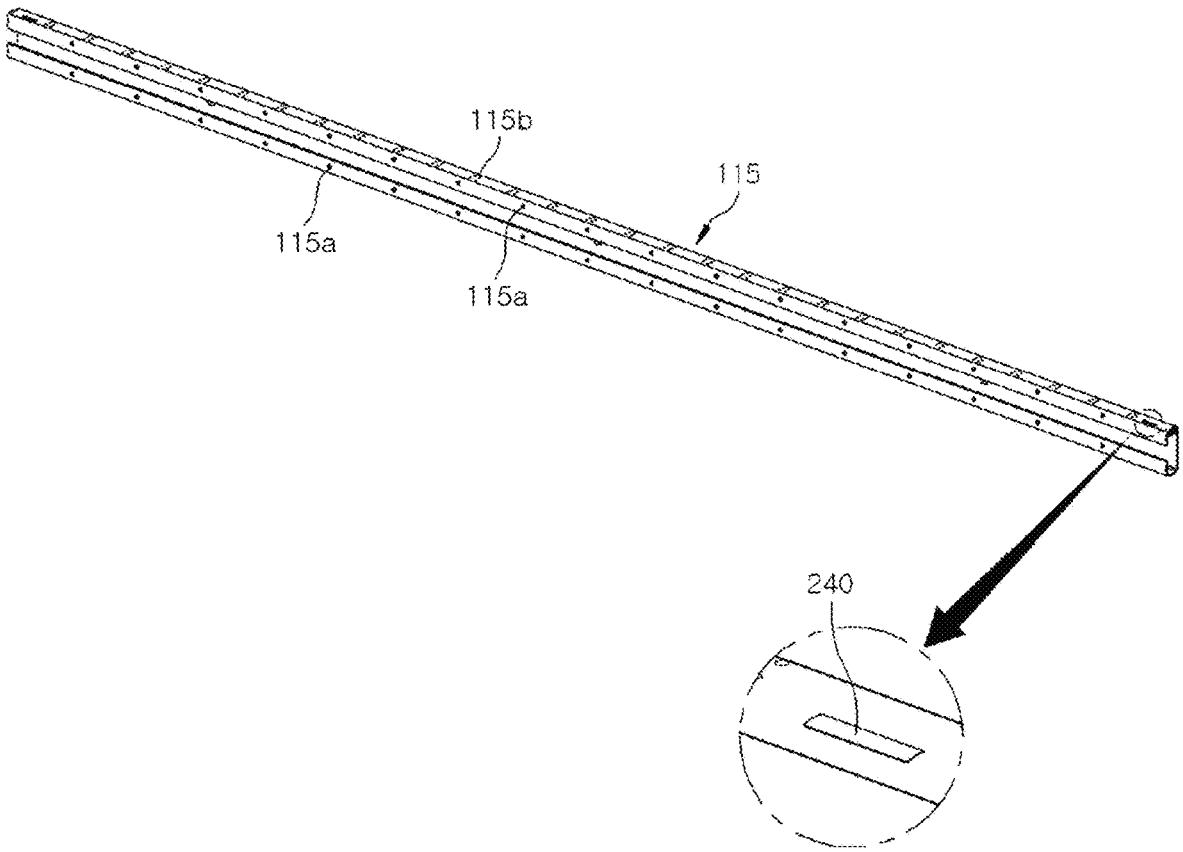
FIG. 12 is a perspective view illustrating the structure of a transverse frame of a modular wall assembly using a solenoid, according to an embodiment of the present invention.

Referring to FIG. 12, the transverse frame 115 may be arranged in a transverse direction for the installation of an installation frame (including the mounting frame 140 and the closing frame 150). The transverse frame 115 may include a plurality of fastening holes 115*a* and 115*b* in the length direction thereof for the connection to a panel or the main frame 110. One or more levels 240 may be mounted on the transverse frame 115 to check whether a water surface, an installation site, or an installation is level. A supply line 120 may be mounted on the inside of the transverse frame 115 to connect supply lines 120 of the main frames 110 to each other. The levels 240 may be mounted on both top ends of the transverse frame 115.

A supply line 120 may be mounted on the inside of a main frame 110 and may supply water, a signal, or electricity. To supply water, a signal, or electricity, the supply line 120 may include, for example, an electrical cord, a speaker wire, an Internet cable, a closed-circuit TV (CCTV) wire, a water supply line, and/or optical fiber.

The withdrawal connector 130 may be exposed to the outside of the main frame 110 and connected to the supply line 120. The withdrawal connector 130 may be mounted on the main frame 110 such that the inside of the main frame 110 is exposed. The withdrawal connector 130 may be coupled to the supply line 120 by way of appropriate force fit or screw coupling or via a separate fitting member or a connection jack. The withdrawal connector 130 may be configured to be connected to a plurality of supply lines 120 and may be mounted on a side of the main frame 110, which facilitates the supply of water, a signal, or electricity.

Figure 5:
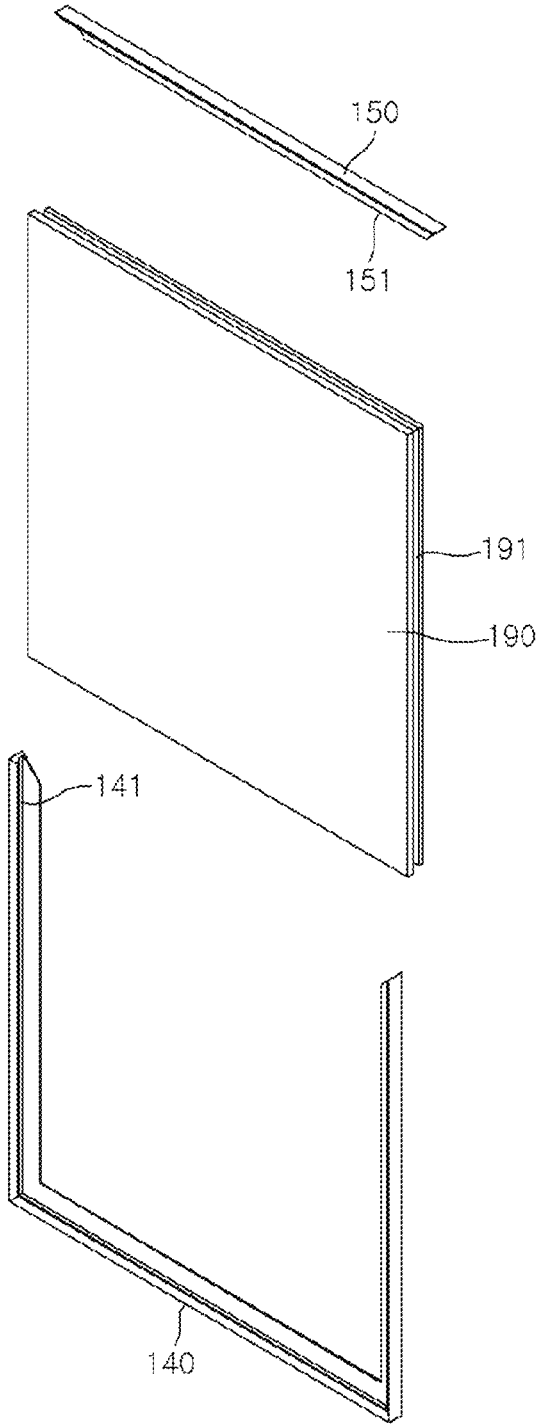
FIG. 5 is a perspective view illustrating an installation frame and a closing frame of a modular wall assembly using a solenoid, according to an embodiment of the present invention.

Referring to FIGS. 3 to 5, a plurality of installation frames (including the mounting frame and the closing frame 150) may be arranged in two dimensions in a plurality of main frames 110 and each may be installed to an edge of a panel 190 or a product. As shown in the present embodiment, each installation frame may be between main frames 110, which are parallel with each other, such that both sides of the installation frame are respectively fixed to the main frames 110, and accordingly, a plurality of installation frames may be arranged in top and bottom directions and left and right directions. When the main frames 110 are horizontal, the installation frames may be arranged in front and back directions and left and right directions.

For example, an installation frame (including the mounting frame 140 and the closing frame 150) may have a U-shape such that the panel 190 or a product is slidably coupled to the inside of the installation frame. The installation frame may include the mounting frame 140 and the closing frame 150. A slide coupling portion 141 may be provided in the inside of the mounting frame 140 to be sliding-coupled to a sliding groove 191 in an edge of the panel 190 or the product, and the detachable unit 160 and the coupling connector 170 may be mounted on the mounting frame 140. The closing frame 150 may be coupled to a side of the panel 190 or the product, thereby surrounding the edge of the panel 190 or the product together with the mounting frame 140, wherein the side of the panel 190 or the product is exposed by an open side of the mounting frame 140. Here, the slide coupling portion 141 of the mounting frame 140 may include a slide coupling protrusion so as to be sliding-coupled to the sliding groove 191. An insertion portion 151 may be provided on a side of the closing frame 150 so as to be inserted into the sliding groove 191.

The panel 190 may include a board or have a structure, which a product supplied with water, a signal, or electricity through the supply line 120 is accommodated in or mounted on. As shown in the present embodiment, the panel 190 may have various circular, quadrangular, and octagonal accommodation structures. The panel 190 may be used as a shelf, a cabinet, or furniture. As shown in FIG. 1, the panel 190 may include a bottom panel 230 used as a baseboard. A product having an installable structure may be directly installed instead of the panel 190. In this case, the product may be made installable in an installation frame (including the mounting frame and the closing frame 150) by forming a sliding groove in the edge of the casing of the product. A product, such as a sprinkler, a humidifier, a frame aquarium, a speaker, or a TV, may be installed in the panel 190. For initial fire extinguishment, a sprinkler 220 may be installed in the bottom panel 230, which is used as an adaptor or a baseboard, in a region near the bottom panel 230, or in a region near an inflammable product or site.

Referring to FIGS. 6 to 10, the detachable unit 160 may be mounted on an installation frame, e.g., the mounting frame 140. When the detachable unit 160 is detachably coupled to the main frame 110, the detachable unit 160 may fix the installation frame (including the mounting frame 140 and the closing frame 150) to the main frame 110. The detachable unit 160 may include a body 161, a solenoid 162, a slider 163, a coupling member 164, a link member 165, a trapping member 166, and a spring 167.

The body 161 may be mounted on an installation frame, e.g., the mounting frame 140, to be inserted into a detaching hole 112 of the main frame 110. The body 161 may be welded or bolted to the mounting frame 140 or integrally formed together with the mounting frame 140.

The solenoid 162 may be fixed to the inside of the body 161 and may be operated by a control signal of an operator 180, which is mounted on an installation frame, e.g., the mounting frame 140. Here, the operator 180 may include a switching element configured to provide the solenoid 162 with operating power, which is supplied from a power line 181 connected to the outside. The operator 180 may be configured to be operable by a user when the operator 180 is exposed outside during the installation or disassembly of an installation frame (including the mounting frame 140 and the closing frame 150). However, embodiments are not limited thereto, and the operator 180 may be mounted on the installation frame (including the mounting frame 140 and the closing frame 150) to be always exposed outside. The operator 180 and the power line 181 may be configured to be handled by anyone for general use or handled by a certain person for security. When the operator 180 and the power line 181 are configured for security, a secure measure, such as insertion of a certain key, a certain switching operation or sequence, fingerprint recognition, or input of certain information, may be additionally provided.

The slider 163 may be slidably mounted on the inside of the body 161. An attractive force may be produced between the slider 163 and the solenoid 162 according to the operation of the solenoid 162. The slider 163 may include iron so as to be attracted by a magnetic force produced by the operation of the solenoid 162. The slider 163 may have a structure or a shape to smoothly slide without tilting in the body 161.

The coupling member 164 may extend outwards from the slider 163. For example, the coupling member 164 may include a shaft vertically mounted on the slider 163.

A plurality of link members 165 may be hinged to the coupling member 164 and arranged in a radial pattern from the center of the coupling member 164. Each link member 165 may include hinge pins 165*a* and 166*b* respectively at both ends thereof for hinge coupling. The link member 165 may be hinged, by the hinge pins 165*a* and 166*b*, to an end of the coupling member 164 and a side of the trapping member 166 described below. When the slider 163 moves toward the solenoid 162, the link members 165 may pull a plurality of trapping members 166 so as to gather the trapping members 166 together.

A first side of a trapping member 166 may be hinged to an end of each of the link members 165. A second side of the trapping member 166 may be hinged to the body 161 so as to provide the trapping member 166 with a trap portion 166*a* trapped in the detaching hole 112. When the coupling member 164 pulls the link members 165 according to the operation of the solenoid 162, the trapping members 166 may gather (see FIG. 10) toward the center of the coupling member 164 such that respective trap portions 166*a* of the trapping members 166 may be released from the detaching holes 112, and accordingly, the mounting frame 140 may be easily detached from the main frame 110. To hinge the second side of each trapping member 166 to the body 161, for example, the second side of the trapping member 166 may be hinge-coupled by a hinge shaft 166*c* to a coupling groove 161*a* of the body 161.

The spring 167 may be mounted on the body 161 to produce an elastic force such that the trapping member 166 returns to an original position, at which the trap portion 166*a* of the trapping member 166 protrudes outwards and is trapped in the detaching hole 112. Accordingly, when the magnetic force is cancelled by stopping the operation of the solenoid 162, the attractive force between the solenoid 162 and the slider 163 may be cancelled, and the trapping member 166 may return to the original position due to the spring 167. Accordingly, the trap portion 166*a* of the trapping member 166 may protrude outwards (see FIGS. 8 and 9) due to the rotation of the trapping member 166 and thus be trapped in the detaching hole 112 of the main frame 110. As a result, the mounting frame 140 may be fixed to the main frame 110 while being suppressed from breaking away from the main frame 110. For example, in a state in which the ring portion of the spring 167 is inserted into the hinge shaft 166*c*, an end of the spring 167 may be fixed to the body 161 and the other end of the spring 167 may elastically support the trapping member 166.

Referring to FIGS. 4 and 7, the coupling connector 170 may be mounted on an installation frame, e.g., the mounting frame 140, to be coupled to the withdrawal connector 130 and thus connected to the supply line 120. A line for supplying, to the outside, water, a signal, or electricity supplied through the supply line 120 may be connected to the coupling connector 170.

The coupling connector 170 and the withdrawal connector 130 may have a male and female structure allowing force fit or the like so that the coupling connector 170 is coupled to the withdrawal connector 130. When a fluid such as water is supplied through the supply line 120, the coupling connector 170 may provide a coupling structure in which the coupling connector 170 and the withdrawal connector 130 are sealed. When electricity or signals are supplied through the supply line 120, a conductor may be included in the coupling connector 170 such that the coupling connector 170 may be electrically connected to the withdrawal connector 130. The coupling connector 170 may provide a structure, in which the withdrawal connector 130 is coupled to a side of the coupling connector 170 and a line taken outside is coupled by force fit to an opposite side of the coupling connector 170. The line taken from the coupling connector 170 may be drawn outside through an opening or a break of the mounting frame 140 and connected to a product installed in an installation frame (including the mounting frame 140 and the closing frame 150) or a product installed in the panel 190 mounted on the installation frame (including the mounting frame 140 and the closing frame 150). Accordingly, necessary electricity, signals, or water may be supplied to product.

Figure 11:
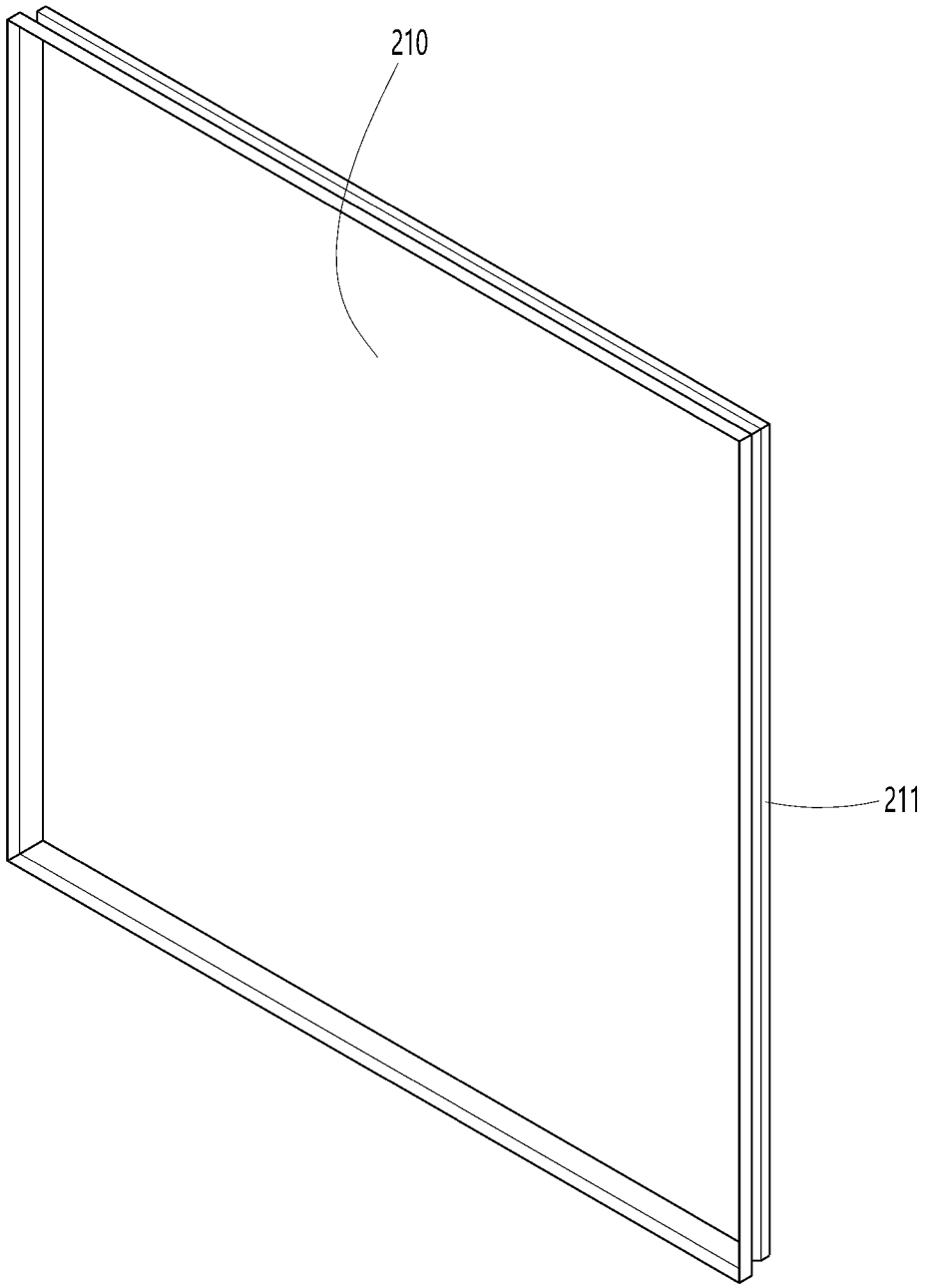
FIG. 11 is a perspective view illustrating a mold of a modular wall assembly using a solenoid, according to an embodiment of the present invention.

Referring to FIG. 11, according to an embodiment of the present invention, the modular wall assembly 100 using a solenoid may further include a mold 210. The mold 210 may be mounted on an installation frame (including the mounting frame 140 and the closing frame 150) and thus mounted on the main frame 110 via the installation frame. The mold 210 may allow an artifact having a desired property and shape to be formed and fixed therein through the molding and hardening of a composite. A sliding groove 211 may be formed along the circumference of the mold 210 to allow the mold 210 to be combined with the installation frame. A space for molding may be formed in one side of the mold 210, except for the edge of the mold 210. The main material of an artifact formed using the mold 210 may include plaster, charcoal, jade powder, stone powder, fiber, glass powder, grain, sand, gravel, straw, or red clay. The artifact may also include a binder so that the artifact is maintained attached to the mold 210 and remains in the shape formed by hardening after molding.

According to a modular wall assembly using a solenoid, assembly and installation may be facilitated by using the solenoid, and not only a panel but also a product, e.g., the sprinkler 220, a humidifier, a frame aquarium, a speaker, or a television (TV), which requires water, signals, or electricity, may be easily installed.

In addition, according to the present invention, water, signals, or electricity required for the operation of a product may be easily supplied, and various types of wall structures including shelves, cabinets, or furniture may be provided.

While the present invention has been described with reference to the accompanying drawings, various changes and modifications may be made without departing from the scope and spirit of the present invention. Therefore, it is to be appreciated that the scope of the present invention is not restricted by the embodiments described above but defined by the appended claims and their equivalents.

What is claimed is:

1. A modular wall assembly using a solenoid, the modular wall assembly comprising:

a plurality of main frames fixed to an installation surface, the plurality of main frames being parallel with and separated from each other;

a supply line mounted on an inside of each of the plurality of main frames, the supply line configured to supply water, a signal, or electricity;

a withdrawal connector arranged in an exposed manner on an outside of each of the plurality of main frames, the withdrawal connector being connected to the supply line;

a plurality of installation frames arranged in two dimensions on the plurality of main frames, each of the plurality of installation frames being installed on an edge of a panel or a product;

a detachable unit mounted on each of the plurality of installation frames, the detachable unit being detachably coupled to each of the plurality of main frames and fixing each of the plurality of installation frames to each of the plurality of main frames; and a coupling connector mounted on each of the plurality of installation frames, the coupling connector being coupled to the withdrawal connector and thus connected to the supply line and being connected to a line for supplying, to the outside, the water, the signal, or the electricity supplied through the supply line, wherein the detachable unit includes:

a body mounted on each of the plurality of installation frames, the body being inserted into a detaching hole formed in each of the plurality of main frames;

a solenoid fixed to an inside of the body, the solenoid being operated by a control signal of an operator mounted on each of the plurality of installation frames;

a slider slidably mounted on the inside of the body, the slider having an attractive force to the solenoid according to an operation of the solenoid;

a coupling member extending outwards from the slider;

a plurality of link members hinged to the coupling member and arranged in a radial pattern from a center of the coupling member;

a plurality of trapping members each having a first side, a second side, and a trap portion, the first side being hinged to an end of each of the plurality of link members, the second side being hinged to the body, the trap portion being trapped in the detaching hole, and the plurality of trapping members being configured to allow the trap portion of each of the plurality of trapping members to be released from the detaching hole by gathering toward the center of the coupling member when the coupling member pulls the plurality of link members according to the operation of the solenoid; and a spring mounted on the body and configured to produce an elastic force to allow each of the plurality of trapping members to return to an original position, at which the trap portion of each of the plurality of trapping members protrudes outwards and is trapped in the detaching hole.

2. The modular wall assembly of claim 1, wherein each of the plurality of main frames has a C-shaped cross-section such that an accommodating space is open in a length direction of each of the plurality of main frames, the accommodating space being provided for installation of the supply line, and each of the plurality of the main frames has a plurality of the detaching holes provided in end portions thereof to be separated from each other in a length direction of each of the plurality of the main frames, the end portions being respectively at both sides of an opening of each of the plurality of the main frames, wherein the detachable unit is coupled to each of the detaching holes such that a pair of adjacent installation frames are fixed to each of the plurality of main frames.

3. The modular wall assembly of claim 1, wherein each of the plurality of installation frames includes:

a mounting frame having a U-shape such that the panel or the product is slidably coupled to an inside of the mounting frame, the mounting frame including a slide coupling portion in an inside thereof to be slidingly coupled to a sliding groove of the panel or the product and having mounted thereon the detachable unit and the coupling connector; and a closing frame coupled to a side of the panel or the product to surround the edge of the panel or the product together with the mounting frame, the side of the panel or the product being exposed by an open side of the mounting frame.

4. The modular wall assembly of claim 1, further comprising a mold mounted on each of the plurality of installation frames and thus mounted on each of the plurality of main frames via each of the plurality of installation frames, the mold allowing an artifact to be formed and fixed therein through molding and hardening of a composite.

5. The modular wall assembly of claim 1, further comprising a transverse frame arranged in a transverse direction for installation of the plurality of installation frames, wherein a level is mounted on the transverse frame to check levelness.

* * * * *